US006848359B2

(12) United States Patent
Ruoff

(10) Patent No.: US 6,848,359 B2
(45) Date of Patent: Feb. 1, 2005

(54) DEVICE FOR PROCESSING CONTINUOUS WEBS

(75) Inventor: Wolfgang Ruoff, Lörrach (DE)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/448,658

(22) Filed: May 29, 2003

(65) Prior Publication Data

US 2003/0230618 A1 Dec. 18, 2003

(30) Foreign Application Priority Data

Jun. 12, 2002 (EP) ..... 02405482

(51) Int. Cl.[7] ..... B41F 19/02

(52) U.S. Cl. ..... 101/5; 101/3.1; 101/212; 101/216

(58) Field of Search ..... 101/212, 216, 101/3.1, 5, 11; 400/120.18; 74/431, 445

(56) References Cited

U.S. PATENT DOCUMENTS 3,641,933 A * 2/1972 Tafel ..... 101/181
4,079,635 A * 3/1978 Hope et al. ..... 74/421 R
5,181,433 A * 1/1993 Ueno et al. ..... 74/409
5,333,546 A * 8/1994 Miyoshi et al. ..... 101/216
5,964,150 A * 10/1999 Kato et al. ..... 101/216
RE36,552 E * 2/2000 Fannin et al. ..... 101/486
6,050,185 A * 4/2000 Richards ..... 101/142
6,109,176 A * 8/2000 Fujio et al. ..... 101/216
6,332,397 B1 * 12/2001 Bolza-Schunemann et al. .. 101/183
6,422,143 B1 * 7/2002 Lawrence et al. ..... 101/216
6,668,721 B2 * 12/2003 Naka ..... 101/218

FOREIGN PATENT DOCUMENTS

EP 1132204 9/2001
FR 1445050 6/1965

* cited by examiner

*Primary Examiner*—Andrew H. Hirshfeld
*Assistant Examiner*—Dave A. Ghatt
(74) *Attorney, Agent, or Firm*—Friedrich Kueffner

(57) ABSTRACT

A device for processing continuous webs has a machine frame and at least one tool arranged on the machine frame for processing the continuous web. A drive device is provided for driving the at least one tool. The drive device is a two-row gear wheel having a first toothing and a second toothing, wherein the first toothing has an inch-based division and the second toothing has a metric division. The at least one tool is driven by the first toothing when processing the continuous web according to an inch-based size and wherein the at least one tool is driven by the second toothing when processing the continuous web according to a metric size.

11 Claims, 2 Drawing Sheets

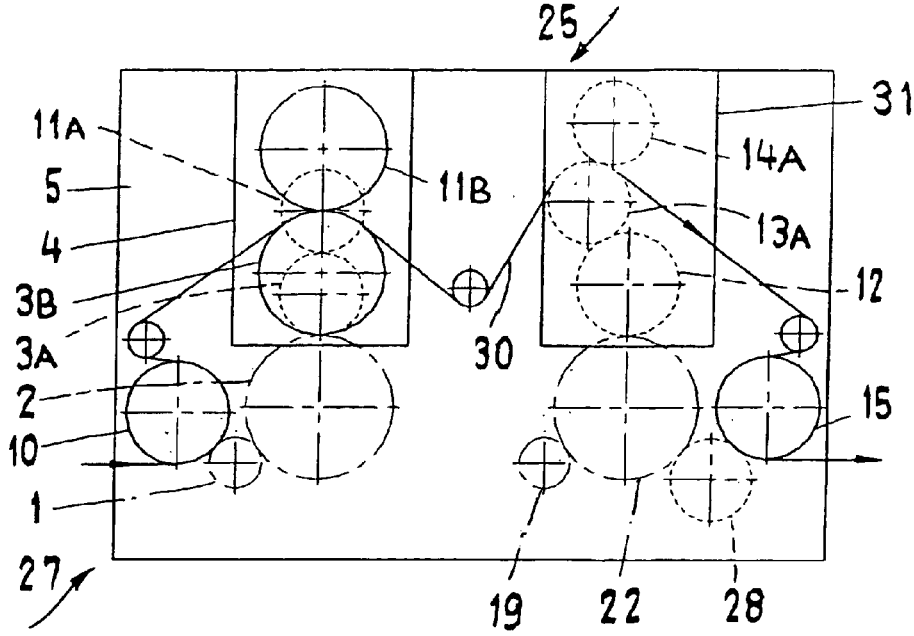
Fig. 1
Fig. 2
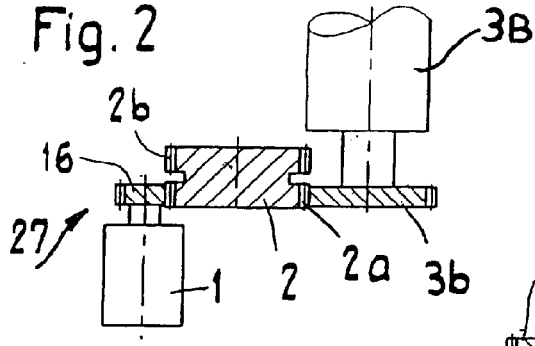
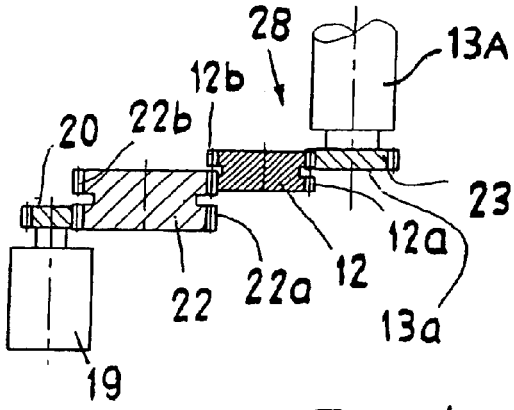
Fig. 4
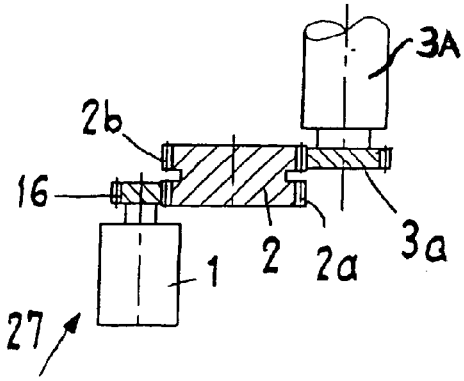
Fig. 3

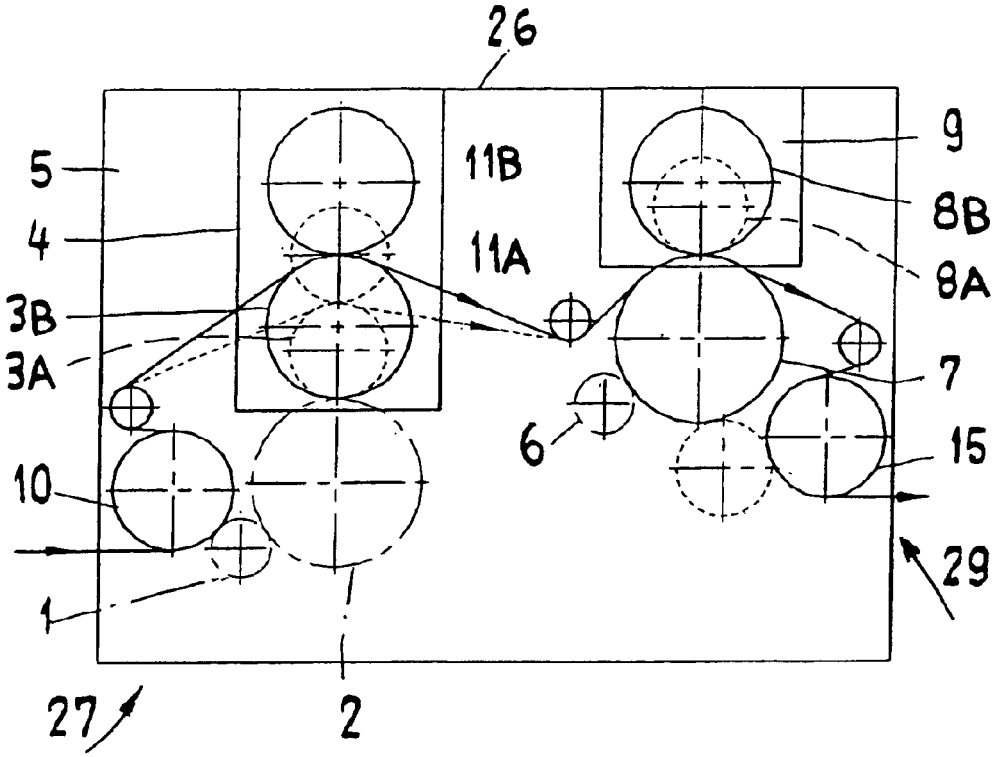
Fig. 5
Fig. 6
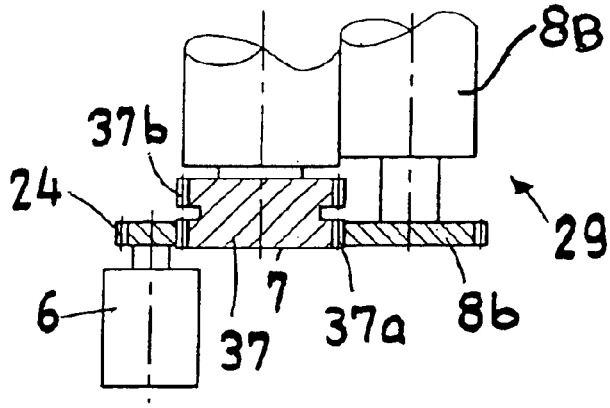
Fig. 7
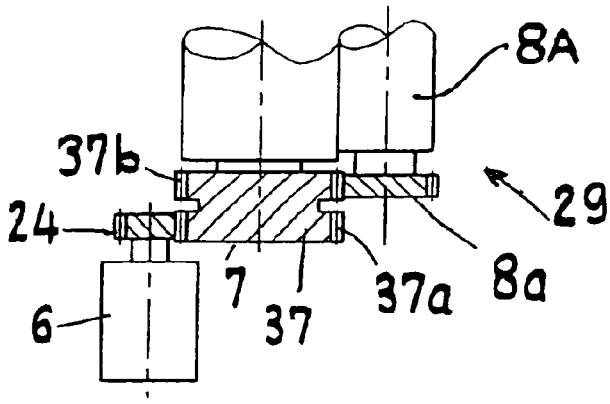

DEVICE FOR PROCESSING CONTINUOUS WEBS

BACKGROUND OF THE INVENTION

1. Field of the Invention

The invention relates to a device for processing continuous webs, comprising a machine frame in which at least one tool for processing continuous webs is arranged and comprising a drive device for actuating the tool.

2. Description of the Related Art

With a rotary offset machine of the assignee according to EP 1 132 204 A, continuous webs can be processed variably with regard to the required size. In this way, printed products can be produced whose section lengths are different. The webs printed by the rotary offset press are processed generally in-line. For example, the webs are hole-punched, perforated, and cut. The further processing is usually also variable with regard to the paper size.

In order to perform a changed of size, for example, from the paper size DIN A4 to DIN A3 (DIN: Deutsche Industrienorm=German Industrial Standard), the tools required for further processing are supported in one or several plug-in units. When carrying out a size change, these plug-in units, known in the art, are exchanged. The plug-in units, for example, are supported on rollers and can thus be easily exchanged. Such plug-in units are known as single-cylinder plug-in units or multi-cylinder plug-in units. A single-cylinder plug-in unit has, for example, a stamping cylinder, a transversely perforating cylinder or a transversely cutting cylinder. This cylinder acts on a counter cylinder which is supported outside of the plug-in unit in the machine frame. A multi-cylinder plug-in unit is provided with several cylinders. They are usually driven by a drive device which generally drives at the same time draw rollers which maintain a predetermined web tension in the machine.

Further processing is carried, as during printing, in metric division or inch division. However, it is not possible to produce precise size lengths according to both divisions with the same device. When the device, as is conventional, is designed for inch-based division, size lengths in the mm range can be produced precisely only in approximation. In order to generate a precise size length in mm, it is customary to cut a strip off the inch-based size. This produces a significant amount of paper waste which must be disposed off. Moreover, an additional blade or knife is required for cutting. Also, cutting is possible only in the case of sheet production.

SUMMARY OF THE INVENTION

It is an object of the present invention to provide a device of the aforementioned kind with which, without producing paper waste, printed products can be manufactured with exact inch-based size lengths as well as precise metric size lengths.

In accordance with the present invention, this is achieved in that the drive device comprises at least one gear wheel with a first toothing and a second toothing wherein the first toothing has an inch-based division and the second toothing has a metric division and wherein, for processing a continuous web according to an inch-based size, the tool for processing the web is driven by the first toothing and, for processing according to a metric size, is driven by the second toothing.

The invention is based on the recognition that certain inch-based sizes provide exact metric section lengths. For example, these are the sizes 20 inch, 25 inch, 30 inch, 35 inch, and 40 inch. The 30 inch size results in a circumference of precisely 762 mm. A gear wheel having such a circumference and 127 teeth provides a tooth division of 6 mm. With this configuration, the most important DIN paper sizes can be produced. Also, all other sizes corresponding to a multiple of 6 mm can be produced.

The device according to the invention provides the user with the possibility of producing exact size lengths for both divisions.

Preferably, the gear wheel is an input wheel on a sizing part, in particular, sizing cylinder. This has the advantage that the sizing can be carried out in inches or mm without this requiring corrections on the cylinder.

According to another embodiment of the invention, a gear wheel is provided wherein the two toothings have the same reference diameter. This has the advantage that in addition to the plug-in unit also a paper conveying roller can be driven by means of the same drive. According to another embodiment of the invention, an intermediate gear wheel is provided which also has two different toothings. By means of such an intermediate gear wheel it is possible to realize additional divisions. For example, by means of such an intermediate gear wheel a printing length of 400 mm can be produced which is not possible with a tooth division of 6 mm because this does not result in a number of teeth that is an integer. Despite this, a size length of 400 mm is however possible by means of the aforementioned intermediate gear wheel.

BRIEF DESCRIPTION OF THE DRAWING

In the drawing:

FIG. 1 shows schematically a view of a device according to the invention;

FIG. 2 is a section of a drive device;

FIG. 3 shows the drive device of FIG. 2 with a different division;

FIG. 4 is a section of another embodiment of the drive device;

FIG. 5 shows schematically a view of a device according to the invention according to another modification;

FIG. 6 shows a section of a drive device; and

FIG. 7 shows a section according to FIG. 6, wherein the drive device has been changed over to a different division.

DESCRIPTION OF THE PREFERRED EMBODIMENTS

The device 25 illustrated in FIG. 1 has a machine frame 5 in which two exchangeable plug-in units 4 and 31 are supported. These plug-in units 4 and 31 are, for example, supported on rollers and can be removed from the machine frame 5 an exchanged. The plug-in unit 4 is a multi-cylinder plug-in unit an has tools, in this case two sizing cylinders 3B and 11B. They have an inch-based configuration. In dashed lines, the sizing cylinders 3A and 11A of a removed plug-in unit are illustrated. They are of a metric configuration. The plug-in unit 4, or example, serves for hole-punching or embossing a printed continuous web 30. This web 30 has been printed on a printing press (not illustrated), for example, a rotary offset printing press. This printing press is arranged upstream of the device 25.

A drive device 27 is arranged in the machine frame 5 and comprises a motor 1, in particular, a servo motor or another drive means for driving, preferably simultaneously, a draw roller 10 or paper conveying roller and a two-row planet wheel 2. The drive device 27 forms together with the plug-in unit 4 a first processing station. For this purpose, the motor 1 is provided with a gear wheel 16 which engages the draw roller 10 and meshes with a toothing 2*a* or 2*b* of the planet wheel 2. According to FIGS. 2 and 3, the gear wheel 16 meshes with the toothing 2*a*. The gear wheel 16 however could also mesh with the toothing 2*b*. The draw roller 10 conveys the printed continuous web 30, independently of the produced section length, at constant speed. The draw roller 10 provides a certain advance or oversize so that the web tension in the device can be maintained. The drive of all stations by means of individual servo motors 1 has the advantage that all stations can be defined or adjusted relative to one another. The plug-in units can be pushed into place at any desired angle position because the travel stroke for registering or adjusting plays no role in the case of a servo drive.

The two toothings 2*a* and 2*b* have the same reference diameter; this is however not mandatory in all cases. The two toothings 2*a* and 2*b* however are different. The first toothing 2*a* is an inch-based toothing and the second toothing 2*b* is a millimeter-based toothing and thus a metric toothing. The circumference of the two toothings 2*a* and 2*b* is, for example, 30 inches and thus precisely 762 mm. For the first toothing 2*a* this provides, for example, an inch-based division of ¼ inch. For the second toothing 2*b*, a division of 6.00 mm results. When a printing length having an inch-based division is to be produced, the sizing cylinder gear 3*b* according to FIG. 2 engages the plane of the first toothing 2*a*. For a metric division, the plug-in unit is exchanged and the sizing cylinder gear 3*a* now in place engages according to FIG. 3 the plane of the second toothing 2*b*. In order to generate a precise different division, only the plug-in unit 4 must be exchanged. The planet wheel 2, as is illustrated, is an input wheel meshing with the sizing cylinder gear 3*a* or the sizing cylinder gear 3*b*.

The second plug-in unit 31 serves also for processing a continuous web 31 by means of another processing step and has two sizing cylinders 13A and 14A as well as an intermediate gear wheel 12. The drive of the sizing cylinders 13A and 14A is realized by means of the drive device 28 which also has a motor 19 as well as a two-row gear wheel 22. The gear wheel 22 has, like the planet wheel 2, two different toothings 22*a* and 22*b* which however have the same reference diameter. The gear wheel 20 of the motor 19 meshes either with the toothing 22*a* according to FIG. 4 or with the toothing 22*b*. The first toothing 22*a* is also provided with an inch-based division while the second toothing 22*b* has a metric division. The circumferences is preferably also 30 inches. In this case, the drive action of the sizing cylinder gear 13*a* is realized by the drive device 28 by means of an intermediate gear wheel 12 which has a first intermediate toothing 12*a* and a second intermediate toothing 12*b*. The first toothing 12*a* has an inch-based division and the second toothing 12*b* a metric division. By means of the drive device 28 a printing length of 400 mm can be produced, for example. The plane of the toothing 12*a* has, for example, a division of 6 mm and 40 teeth and the plane of the toothing 12*b* has a division of 10 mm and 24 teeth. This results in a circumference of exactly 240 mm, respectively. When a printing length of an inch-based size is to be produced, the plug-in unit 31 is exchanged and the newly inserted sizing cylinder is then in engagement with the first toothing 12*a*. By means of the drive device 28, a draw roller 15 is driven at the same time. The plug-in unit 31 forms together with the drive device 28 a second processing station. Additional processing stations, not illustrated, are also possible which are of a similar configuration but provided with different tools.

FIG. 5 shows a device 26 which, in addition to the above described plug-in unit 4, has a single-cylinder plug-in unit 9. This unit 9 comprises a sizing cylinder 8B which can be exchanged for a sizing cylinder 8A. The sizing cylinders 8A and 8B are, for example, stamping cylinders, transverse perforating cylinders or transverse cutting cylinders. The sizing cylinder 8A is provided for a metric size and the sizing cylinder 8B is provided for an inch-based size. The sizing cylinder gears 8*a* and 8*b* are driven by a counter cylinder 7 and act on it. The counter cylinder 7 is positioned outside of the plug-in unit 9 and is supported in the machine frame 5. The drive action of the counter cylinder 7 is realized by a drive device 29 which, according to FIG. 6, has motor 6 with a gear wheel 24. The motor 6 is a servo motor but can also be replaced by a different drive means. The drive 29 as also a two-row gear wheel 37 that is however directly fastened on the counter cylinder 7. The drive action of the cylinder gear 8*b*, according to FIG. 6, is realized by a first toothing 37*a* having an inch-based division. When changing sizes, the plug-in unit 9 is exchanged and the sizing cylinder 8A is inserted. According to FIG. 7, the gear 8*a* is in engagement with the second toothing 37*b* having a metric division. The two-row gear wheel 37 matches the design of the above described planet wheel 2 and both toothings are thus provided with the same reference diameter.

In the illustrated embodiments, the processing stations are preferably driven independently by servo motors 1, 6, and 19. Alternatively, all processing stations can be driven together in a fixed arrangement so that only one servo drive is required.

The first toothing 2*a*, 22*a*, 37*a* and the second toothing 2*b*, 22*b*, 37*b* can have different reference diameters. However, they are identical when the drive device 27, 28, 29 drives, simultaneously with the plug-in unit 4, a further plug-in unit 9 or 31 and/or a draw roller 10 or 15. When the reference diameters are identical, a drive action, for example, by means of a gear train or a vertical shaft, is also possible for several or all plug-in units; this provides for a particularly inexpensive but functionally efficient device.

While specific embodiments of the invention have been shown and described in detail to illustrate the inventive principles, it will be understood that the invention may be embodied otherwise without departing from such principles.

What is claimed is:

1. A device for processing continuous webs, comprising:

a machine frame;

at least one tool arranged on the machine frame for processing a continuous web;

a drive device for driving the at least one tool;

wherein the drive device is a two-row gear wheel comprising a first toothing and a second toothing, wherein the first toothing has an inch-based division and the second toothing has a metric division, the drive device comprising a two-row intermediate gear wheel having a first intermediate toothing and a second intermediate toothing; and wherein the at least one tool is driven by the first toothing when processing the continuous web according to an inch-based size and wherein the at least one tool is drive by the second toothing when processing the continuous web according to a metric size.

2. The device according to claim 1, wherein the gear wheel has a reference circumference that is a multiple of five inches.

3. The device according to claim 2, wherein the reference circumference is 30 inches.

4. The device according to claim 1, wherein the at least one tool is a sizing part and wherein the two-row gear wheel is an input wheel acting on the sizing part.

5. The device according to claim 1, further comprising a cylinder interacting with the at least one tool, wherein the two-row gear wheel is mounted on the cylinder.

6. The device according to claim 5, wherein the cylinder is a counter cylinder.

7. The device according to claim 6, wherein the counter cylinder is driven.

8. The device according to claim 1, comprising an exchangeable plug-in unit wherein the at least one tool is supported in the exchangeable plug-in unit.

9. The device according to claim 2, comprising two to six processing stations provided with the at least one tool, wherein the continuous web passes sequentially through the two to six processing stations.

10. The device according to claim 9, wherein the first and second toothings of the two-row gear wheel have the same reference diameter.

11. The device according to claim 9, comprising exchangeable plug-in units provided with the at least one tool, wherein the drive device drives several of the plug-in units.

* * * * *